US011170910B2

(12) United States Patent
Milouchev et al.

(10) Patent No.: US 11,170,910 B2
(45) Date of Patent: Nov. 9, 2021

(54) POWER CABLES FOR ELECTRIC SUBMERSIBLE PUMP

(71) Applicant: PRYSMIAN S.P.A., Milan (IT)

(72) Inventors: Toma Milouchev, North Dighton, MA (US); Bill Foe, North Dighton, MA (US); Edward Wiencek, North Dighton, MA (US)

(73) Assignee: PRYSMIAN S.P.A., Milan (IT)

( * ) Notice: Subject to any disclaimer, the term of this patent is extended or adjusted under 35 U.S.C. 154(b) by 0 days.

(21) Appl. No.: 16/619,748

(22) PCT Filed: Jun. 9, 2017

(86) PCT No.: PCT/US2017/036733
§ 371 (c)(1),
(2) Date: Dec. 5, 2019

(87) PCT Pub. No.: WO2018/226241
PCT Pub. Date: Dec. 13, 2018

(65) Prior Publication Data
US 2020/0211733 A1 Jul. 2, 2020

(51) Int. Cl.

| | |
|---|---|
| ***H01B 7/06*** | (2006.01) |
| ***H01B 7/04*** | (2006.01) |
| ***F04B 47/06*** | (2006.01) |
| ***H01B 7/02*** | (2006.01) |
| ***H01B 7/08*** | (2006.01) |
| ***H01B 9/06*** | (2006.01) |
| ***H01B 13/14*** | (2006.01) |

(52) U.S. Cl.
CPC ..... *H01B 7/046* (2013.01); *F04B 47/06* (2013.01); *H01B 7/0216* (2013.01); *H01B 7/08* (2013.01); *H01B 9/06* (2013.01); *H01B 13/14* (2013.01)

(58) Field of Classification Search
CPC . H01B 7/02; H01B 7/04; H01B 7/046; H01B 7/0216; H01B 7/08; H01B 9/02; H01B 9/04; H01B 9/06; H01B 13/14
USPC ..... 174/47, 102 R, 106 R; 138/103, 108, 138/110, 111
See application file for complete search history.

(56) References Cited

U.S. PATENT DOCUMENTS 1,999,354 A * 4/1935 Branthwaite ..... H01B 7/201 174/26 R
5,894,104 A * 4/1999 Hedberg ..... H01B 7/046 174/36

(Continued)

FOREIGN PATENT DOCUMENTS

WO WO 2016/094244 A1 6/2016

OTHER PUBLICATIONS

International Search Report dated Aug. 14, 2017 in PCT/US2017/036733 filed on Jun. 9, 2017.

(Continued)

*Primary Examiner* — William H. Mayo, III
(74) *Attorney, Agent, or Firm* — Oblon, McClelland, Maier & Neustadt, L.L.P.

(57) ABSTRACT

A downwell pump three-phase power cable containing three power conductors each provided with at least one extruded polymeric insulating layer made of an insulating polymer selected from an ethylene copolymer or a fluoropolymer, a metal tube in radial external position with respect to the insulating layer, and an extruded encapsulating layer embedding the three power conductors and made of a fluoropolymer.

13 Claims, 2 Drawing Sheets

(56) References Cited

U.S. PATENT DOCUMENTS

| | | | | |
|---|---|---|---|---|
| 6,323,420 | B1 * | 11/2001 | Head | F16L 7/00 174/47 |
| 2012/0093667 | A1 * | 4/2012 | Manke | H01B 3/306 417/410.1 |
| 2014/0102749 | A1 | 4/2014 | Varkey | |
| 2016/0047210 | A1 * | 2/2016 | Pinkston | E21B 43/128 166/66.4 |
| 2016/0217888 | A1 * | 7/2016 | Xiang | E21B 17/003 |
| 2016/0293294 | A1 * | 10/2016 | Matlack | F04D 13/0693 |
| 2017/0058098 | A1 | 3/2017 | Thomas et al. | |
| 2017/0330647 | A1 * | 11/2017 | Xiao | H01B 7/046 |

OTHER PUBLICATIONS

Combine Russian Federation Office Action and Search Report dated Sep. 24, 2020 in Patent Application No. 2019143481/07(084279) (with English translation), 10 pages.

African Regional Intellectual Property Organization (ARIPO) Search Report (Form No. 18) dated Dec. 17, 2020, in Application No. AP/P/2019/012051.

Office Action in corresponding Russian Application No. 2019143481 dated Feb. 5, 2021. (w/English Translation).

Office Acton in corresponding Chinese Patent Application No. 201780091787 dated Dec. 28, 2020.

African Regional Intellectual Property Organization (ARIPO) dated Jun. 21, 2021, in Application No. AP/P/2019/012051.

Office Action in corresponding Japanese Application No. 201780091787.9, dated Aug. 9, 2021. (w/English Translation).

* cited by examiner

POWER CABLES FOR ELECTRIC SUBMERSIBLE PUMP

BACKGROUND

The present disclosure relates to a power cable for electric submersible pump (ESP) systems.

ESP systems comprise both downhole and surface components. Downhole ESP system components include motor, protectors, pump sections, pump intakes, power cables, gas handling equipment and downhole sensors. Surface components include pump-control equipment such as variable-speed drives (VSD) and electric power supply, the latter being connected to the motor of the pump of the system by armour-protected cables.

In many field applications, ESP systems provide several operational advantages. The pumps can be manufactured from high-grade, corrosion-resistant metal alloys for application in well environments with high-gas/oil ratio (GOR) fluids, high temperatures and fluids containing corrosive acid gases. However, a number of operational challenges should be considered when running ESPs. Even though ESP systems can be built with special abrasion-resistant metal alloys and upgraded radial bearing materials and configuration, ESP run times can be severely compromised in high sand and solids content environments.

Generally, a typical ESP system comprises an electric submersible pump (ESP) to be positioned in the bottom of a well, at some km depth, connected to a piping system to convey the production fluid (oil) to the surface. The motor of the ESP is a three-phase alternate current (AC) one powered by a cable connected to an electric supply and regulation system on the surface of the well.

As reported by http://petrowiki.org/Electrical_submersible_pumps, ESP power cables are specially constructed three-phase power cables, designed specifically for downhole well environments. The cable design should be small in diameter, protected from mechanical abuse, and impervious to physical and electrical deterioration because of aggressive well environments. They can be manufactured in either round or flat configurations, using several different insulation and metal armour materials for different hostile well environments. Typically, these cables have an expected life span of 3 years at most.

ESP power cables typically transport AC current up to 200 A or more, depending on the ESP power requirements.

US 2012/0093667 relates to power cables utilized to transmit electrical power to electric submersible pumps (ESPs), in particular to a power cable suited for installation in environments wherein the temperature is continuously in the range of about 500 degrees Fahrenheit (260 degrees Celsius). A power cable of this reference has three electrical conductors and an insulator including at least two insulating layers, formed of the same or different material, for example polyimide or fluoropolymer. A protective sheath is disposed over the insulated conductor and may be made of a metallic material such as stainless steel or Monel. Insulated and sheathed conductors are interconnected by wrapping with an outer layer which may be constructed of a metallic or non-metallic material.

US 2007/0046115 relates to a power cable for supplying power to the pump motor of an electrical submersible pump assemblies. The power line is made up of two sections, a motor lead and a power cable. The motor lead is configured such that each insulated conductor is located within a separate metallic impermeable tube formed of a non-electromagnetic material, such as Monel or stainless steel.

Preferably each conductor has at least two layers of insulation, at least one of which resists high temperatures. The tubes are wrapped with a metallic armor.

WO 2015/077207 relates to a cable for downhole equipment. As an example, a flat ESP cable rated to about 5 kV may include a copper conductor(s), oil and heat resistant EPDM rubber insulation, a barrier layer (e.g., lead and/or fluoropolymer), a jacket layer (e.g., oil resistant EPDM or nitrile rubber), and armor (e.g., galvanized or stainless steel or alloys that include nickel and copper such as Monel alloys).

To ensure optimal ESP performance, downhole sensors may be installed to continuously acquire real-time system measurements such as pump intake and discharge pressures and temperatures, vibration and current leakage rate.

Tubing Encapsulated Cables (TECs) are used to provide both power and signal transmission to and from the downhole sensors and the data acquisition unit on surface. The TEC is rated for harsh downhole environments and can comprise layer/s of polymeric encapsulation for protection. Various TEC configurations are available depending on the downhole environment and application.

For example, a TEC suitable for operating in harsh environment at temperatures up to 300° C. is disclosed by the brochure "Tubing Encapsulated Cable" (2013) of the Applicant. This TEC comprises a copper conductor sequentially coated by a fluorinated ethylene propylene (FEP) insulating layer, a polypropylene filler, a tube in alloy 825, and a perfluoroalkoxy encapsulation. These cables have a conductor size from 18 AWG to 8 AWG (corresponding to a cross-section area of from 0.52 $mm^2$ to 8.36 $mm^2$) and typically transport a direct current (DC) from 5 to 20 mA. These cables can be used as an individual cable or arranged in a flatpack construction with other components, including optical fibres, copper signal cables, hydraulic control and chemical injection lines as well as possible mechanical components for enhancing crush resistance and to provide additional longitudinal strength. In this case, the encapsulation collectively surrounds all of the flatpack components.

SUMMARY

There is the need for a power cable for operating an ESP system, in particular for the power supply of the system pump motor, having an increased life span, for example longer than 5 years, in the challenging environment of the downwell, especially at temperatures greater than 200° C.

The Applicant has noticed that available ESP cables generally provide a limited operating life, on the order of some months or, at most, a few years, after which it is necessary to extract the entire ESP system from the well in order to replace the cables.

This significantly increases costs and labour.

The presently available ESP cables are subject to early failure due in part to the corrosive chemical environment and the temperature of the well environment.

In an ESP cable, protection against chemical corrosion may be attained by providing a lead sheath or, alternatively, a layer made of chemically resistant polymers, such as fluoropolymers, around the conductors.

However, when lead is used, due to its poor mechanical properties, additional mechanical protection is required, generally in the form of a further helically wound metal tape layer, which increases the cost and weight of the cable.

When protection is provided by chemically resistant polymers, the Applicant noticed that this chemical resistance can decrease during the operational life of the cable.

In addition, the Applicant noticed that when power is transported into a cable, in particular in AC, in order to operate the motor of the system pump, heat is generated within the cable, due to Joule effect, insulation losses etc., causing the temperature to rise. The thermal resistivity of the polymers around the conductors hinders the heat dissipation from the conductors. As a consequence, the cable internal temperature may harmfully increase during operation. In addition, some chemically resistant polymers do not provide electrical properties suitable to enable a sufficient operating life span under the applied voltage.

The Applicant found that an increased life span for a three-phase power cable for ESP system even operating at high temperature (greater than 200° C.) may be obtained by providing a cable wherein each phase conductor insulation comprises a specific polymer layer and is arranged within a welded metal tube, and a common fluoropolymer encapsulating layer surrounds the three-phases.

This enables the selection of insulation materials based on the temperature resistance and electric properties, while the protection from chemicals, as well as the mechanical protection, is attained by the welded metal tube surrounded by a fluoropolymer encapsulating layer.

Therefore, the present disclosure includes a downwell pump three-phase power cable comprising three power conductors, each provided with at least one extruded polymeric insulating layer made of an insulating polymer selected from an ethylene copolymer or a fluoropolymer; a metal tube in a radial external position with respect to the insulating layer; and an extruded encapsulating layer embedding the three power conductors and made of a fluoropolymer.

In the following, each power conductor surrounded by at least one insulating layer will be referred to as an "insulated conductor".

In the following, each insulated conductor surrounded by a metal tube will be referred to as a "cable core".

Power cables of the present disclosure are particularly suitable for feeding electrical submersible pump (ESP) systems, more particularly a motor of an ESP system.

Power cables of the present disclosure are particularly suitable for the transport of alternate current (AC).

Power cables of the present disclosure can have either a round or a flat cross-section. In case of a round cross-section, the three cable cores are preferably stranded together. In case of a flat cross-section, the three cable cores are preferably in mutual planar configuration (parallel and laying in a common plane).

In power cables of the present disclosure, each of the power conductors can have a size of at least 6 AWG (13.3 $mm^2$); preferably each of the power conductors may have a size up to 2/0 AWG (67.4 $mm^2$).

Each power conductor can be made of copper or aluminium, in form of stranded wires or of solid rod.

According to one embodiment, the insulating ethylene copolymer is an ethylene propylene diene monomer (EPDM) copolymer. Such embodiments may be preferred, for example, when a higher voltage rating is required for the cable.

According to another embodiment, the insulating fluoropolymer is a perfluoroether, such as a perfluoroalkoxy alkane (PFA). in other embodiments, the insulating fluoropolymer is a high purity fluoropolymer having impurities smaller than 40 μm in size.

In one embodiment, the cable comprises two insulating layers, hereinafter referred to as inner and outer extruded insulating layers. A two layered insulating system can be used when impurities are known or suspected to be contained in the insulating material(s); the presence of two layers minimizes the contamination distribution in a particular cross section.

Each single or inner insulating layer of the cable may be extruded around and in direct contact with the relevant power conductor.

The inner and the outer extruded insulating layers of cables of the present disclosure may be made of different insulating polymers or of the same insulating polymer.

In one embodiment, the insulating polymer(s) is/are coextruded. Coextrusion of the insulating polymer(s) may enhance the adhesion between inner and outer insulating layers.

In some embodiments, each metal tube of the cable is made of a nickel-iron-chromium alloy, such as a titanium-stabilized austenitic nickel-iron-chromium alloy, optionally added with molybdenum and copper. For example, in some embodiments the metal tube can be made of an Incoloy® alloy, preferably Incoloy® 825.

In some embodiments, each metal tube of the cable is provided around an insulated conductor, preferably in direct contact with the insulating layer (in case of single layer insulation) or with the outer insulating layer (in case of a two layer insulation).

In some embodiments, each metal tube of the cable has a wall thickness of from 0.5 to 2.5 mm.

The metal tubes are preferably provided to the cable according to the following procedure. A cold rolled strip of metal is formed into a tubular configuration around an insulated conductor and longitudinally seam welded using, for example, the gas tungsten arc welding. The tube is seam welded at an outside diameter larger than that of the insulated conductor, in order to protect the latter from the heat generated by the welding operation, and then cold drawn to final size in contact with the insulation layer of the insulated conductor.

In some embodiments, the extruded encapsulating layer may be made of a perfluoroether, such as a perfluoroalkoxy alkane (PFA).

The cable of the present disclosure is suitable for operating at a temperature up to 230° C. or more, carrying an alternate current greater than 100 A, for example from 100 A to 300 A, at a voltage of from 4 kV to 10 kV.

For the purpose of the present description and of the appended claims, the words "a" or "an" are employed to describe elements and components of the present disclosure. This is done merely for convenience and to give a general sense of the present disclosure. This description and claims should be read to include one or at least one and the singular also includes the plural unless it is obvious that it is meant otherwise.

For the purpose of the present description and of the appended claims, except where otherwise indicated, all numbers expressing amounts, quantities, percentages, and so forth, are to be understood as being modified in all instances by the term "about". Also, all ranges include any combination of the maximum and minimum points disclosed and include any intermediate ranges therein, which may or may not be specifically enumerated herein.

BRIEF DESCRIPTION OF THE DRAWINGS

Further characteristics will be apparent from the detailed description given hereinafter with reference to the accompanying drawings, in which.

DETAILED DESCRIPTION OF THE PREFERRED EMBODIMENTS

Figure 1:
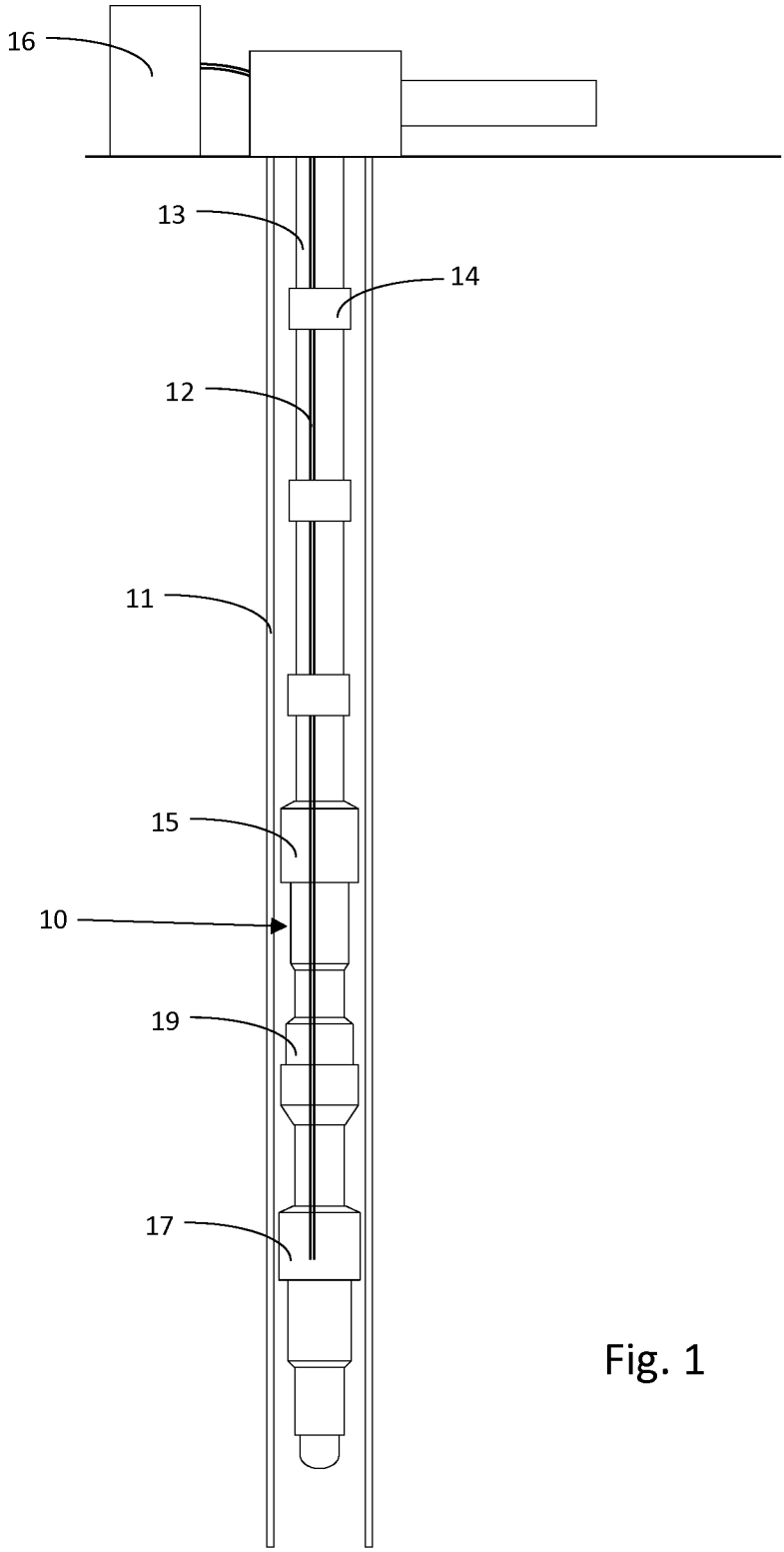
FIG. 1 illustrates an ESP system including a cable of the present disclosure.

FIG. 1 shows an example of an ESP system construction, wherein a well is shown having a casing 11 with a tubing 13 and an ESP system 10 provided therein.

The ESP system 10 comprises an electric submersible pump (ESP) 15 (also known as down well pump, DWP) secured to the lower end of the tubing 13. ESP 15 is operatively connected to a motor 17, optionally through a protector 19 which prevents well fluids from entering the motor 17. Motor 17 is typically a three-phase alternate current (AC) motor designed to operate with voltages generally ranging from about 3 to about 5 kV, but ESP systems can operate at higher voltages, depending, for example, on the well depth and/or heat, as explained below.

Power is provided to the motor 17 from an electric supply and regulation system (ESRS) 16 (on the surface), via a power cable 12. To limit cable movement in the well and, when needed, to support its weight, the cable 12 may be secured to the tubing 13 by fasteners 14, in form of bands, clamps or the like. The ESRS 16 should provide a voltage higher than that required by the motor 17 to compensate for a voltage drop in the power cable, which can be significant in deep installations (e.g. deeper than 1.5 km), requiring long power cables.

Figure 2:
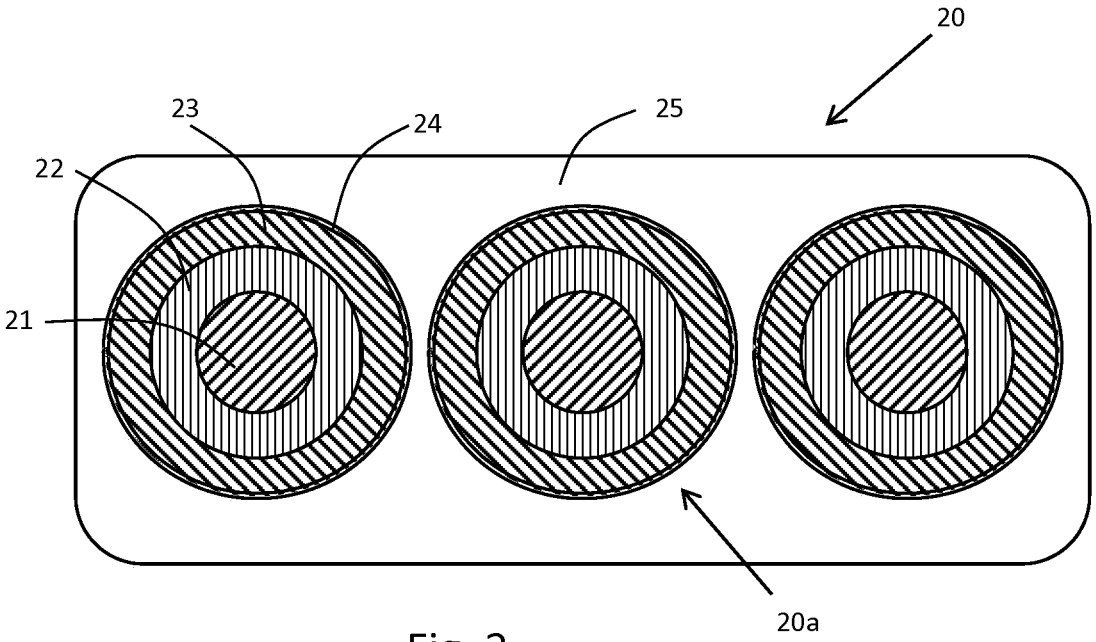
FIG. 2 shows a cross-section of an embodiment of a cable of the present disclosure.

FIG. 2 illustrates an AC power cable 20 having a flat cable comprising three power conductors 21. Each conductor 21 is made in form of a solid copper rod. The conductor 20 is a 6 AWG having a nominal outer diameter of 4.12 mm. Such cable is rated for carrying 5 kV.

Each power conductor 21 is surrounded and in direct contact with an inner insulating layer 22 made of a high purity PFA. The inner insulating layer 22 has a wall thickness of 0.51 mm.

The inner insulating layer 22 is surrounded and in direct contact with an outer insulating layer 23 made of a high purity PFA. The outer insulating layer 23 has a wall thickness of 1.45 mm.

The inner and outer insulating layers 22, 23 are rated for a temperature up to 250° C.

Metal tubes 24 are provided to surround each outer insulating layer 23. Each metal tube 24 is made of Incoloy® 825. Metal tubes 24 having a wall thickness of 0.71 mm and an outer diameter of 9.53 mm. Each metal tube 24 can be coloured and/or printed for identification purposes.

Each power conductor 21 with the relevant inner insulating layer 22, outer insulating layer 23 and metal tube 24 forms a cable core 20*a*.

The three cable cores 20*a* are embedded in an encapsulating layer 25. The encapsulating layer is made of a PFA. For example, the encapsulating layer 25 has outer dimensions of 40 mm×15 mm.

Figure 3:
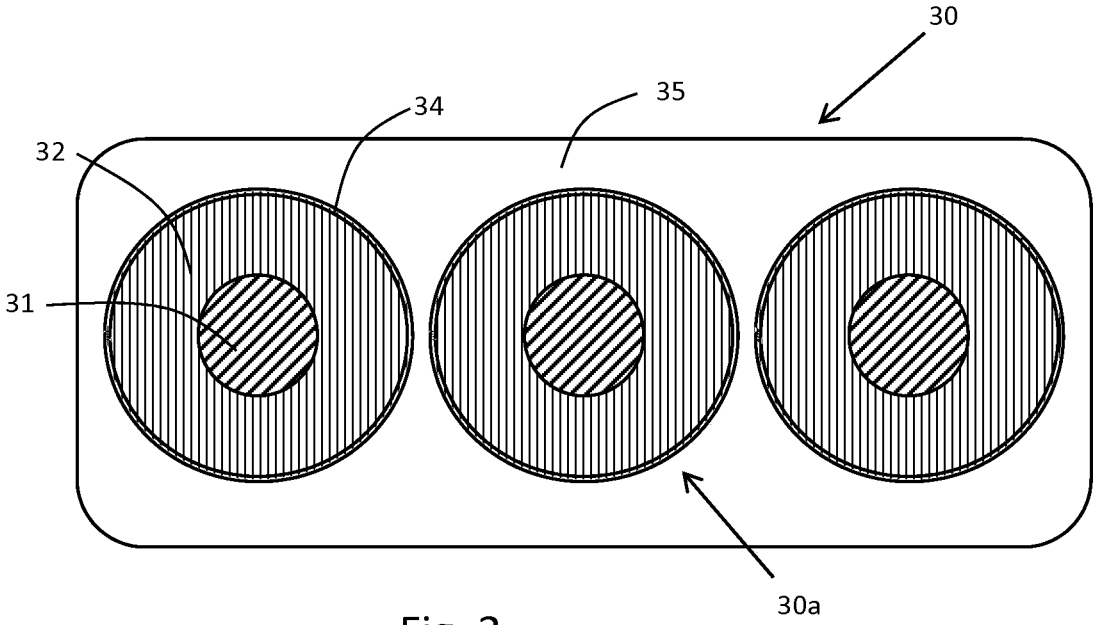
FIG. 3 shows a cross-section of another embodiment of a cable of the present disclosure.

FIG. 3 illustrates an AC power cable 30 having a flat cable comprising three power conductors 31. Each conductor 30 is made in form of a solid bare copper rod. The conductor 30 is a 6 AWG, having a nominal outer diameter of 4.12 mm. It can be suitable for carrying 5 kV.

Each power conductor 31 is surrounded and in direct contact with a single inner insulating layer 32 made of an EPDM. For example, the inner insulating layer 22 has a wall thickness of 1.96 mm.

The insulating layer 32 is rated for a temperature up to of 232° C.

Metal tubes 34 are provided to the single insulating layer 32. Each metal tube 34 is made of Incoloy® 825. For example, metal tube 34 has a wall thickness of 0.71 mm. Each metal tube 34 can be coloured and/or printed for identification purposes.

Each power conductor 31 with the relevant insulating layer 32 and metal tube 34 forms a cable core 30*a*.

The three cable cores 30*a* are embedded in an encapsulating layer 35. The encapsulating layer is made of a PFA. For example, the encapsulating layer 35 has outer dimensions of 40 mm×15 mm.

Electric Breakdown Test

On two AC power cables 20 of FIG. 2 an electric breakdown test was carried out using the following conditions:

Initial test voltage: 7.8 kV AC

Step Voltage: 3.2 kV AC

Test Time: 5 minutes at each test voltage

Finish: Sample breakdown

Specimen Length: 4.572 m.

Both cables experienced no breakdown up to 33.4 kV AC, and one of them had a breakdown over 39.9 kV AC.

Aging Test

Two AC power cables 20 of FIG. 2, 12 m long, were tested under electric and thermal stress. The cables were subjected to 5 kV between the conductor and the metal tube for 120 days at a temperature of 200 OC.

The test was successfully passed by both cables with no breakdown. The visual inspection showed no problem or sign of electric stress on the insulation, even the colour of the insulation itself was good.

Mechanical Tests

Three AC power cables 20 of FIG. 2 were tested according to ASTM B704 and ASTM B751, at a pull-out force of about 44 kg. The results are set forth in Table 1.

TABLE 1

| Sample | Yield strength, ksi (MPa) | Ultimate tensile strength (%) |
|---|---|---|
| 1 | 128.2 (883.9) | 155.9 |
| 2 | 135.2 (932.2) | 161.1 |
| 3 | 136.7 (942.5) | 162.1 |

The calculated external collapse pressure (per American Petroleum Institute, API 5C3) based on worst case dimensions and minimum yield strength is 10,324 psi.

The calculated external collapse pressure (per API 5C3) based on nominal dimensions and typical yield strength (120 ksi; 827.4 MPa) is 15.258 ksi (105.2 MPa).

In the most conservative rating the tested cables of the present disclosure exceed the pressure rating of 50 N/mm$^2$ by a factor of 1.4. Typically, the pressure can be exceeded by a factor of 2.10.

The invention claimed is:

1. A downwell pump three-phase power cable, comprising:

three power conductors each provided with at least one extruded polymeric insulating layer, made of an insulating polymer selected from ethylene copolymer or fluoropolymer;

three metal tubes wherein each metal tube individually encapsulates each of the three power conductors and is set in radial external position with respect to the insulating layer; and an extruded encapsulating layer embedding the three metal tubes and made of a fluoropolymer, wherein said extruded encapsulating layer is the outer-most layer of said power cable.

2. The power cable according to claim 1, having a round or a flat cross-section.

3. The power cable according to claim 1, wherein the conductor size is of at least 6 AWG.

4. The power cable according to claim 1, wherein the conductor size is up to 2/0 AWG.

5. The power cable according to claim 1, wherein the insulating polymer is ethylene propylene diene monomer.

6. The power cable according to claim 1, wherein the insulating fluoropolymer is a perfluoroether.

7. The power cable according to claim 1, wherein the insulating fluoropolymer is a high purity one having impurities of size lower than 40 μm.

8. The power cable according to claim 1, comprising an inner extruded insulating layer and an outer extruded insulating layer.

9. The power cable according to claim 8, wherein the inner extruded insulating layer and the outer extruded insulating layer are made of the same insulating polymer.

10. The power cable according to claim 1, wherein each metal tube is made of a nickel-iron-chromium alloy.

11. The power cable according to claim 10, wherein each metal tube is made of a titanium-stabilized austenitic nickel-iron-chromium alloy, optionally added with molybdenum and copper.

12. The power cable according to claim 1, wherein each metal tube is seam welded.

13. The power cable according to claim 1, wherein the extruded encapsulating layer is made of a perfluoroether.

* * * * *